US012196538B2

(12) United States Patent
Jones et al.

(10) Patent No.: US 12,196,538 B2
(45) Date of Patent: Jan. 14, 2025

(54) SMALL CALIBER CRIMPING PRIMER AND PRIMER FEED

(71) Applicant: BITTERROOT TOOL & MACHINE, INC., Stevensville, MT (US)

(72) Inventors: Randy J. Jones, Stevensville, MT (US); Jeff C. Hritcu, Stevensville, MT (US)

( * ) Notice: Subject to any disclaimer, the term of this patent is extended or adjusted under 35 U.S.C. 154(b) by 46 days.

(21) Appl. No.: 18/202,654

(22) Filed: May 26, 2023

(65) Prior Publication Data

US 2023/0296362 A1 Sep. 21, 2023

Related U.S. Application Data

(63) Continuation of application No. 17/684,264, filed on Mar. 1, 2022, now Pat. No. 11,698,246.

(60) Provisional application No. 63/155,121, filed on Mar. 1, 2021.

(51) Int. Cl.
*F42B 33/04* (2006.01)
*F42B 33/00* (2006.01)

(52) U.S. Cl.
CPC ..... *F42B 33/04* (2013.01); *F42B 33/002* (2013.01); *F42B 33/004* (2013.01); *F42B 33/005* (2013.01)

(58) Field of Classification Search
CPC ..... F42B 33/04; F42B 33/002; F42B 33/004
See application file for complete search history.

(56) References Cited

U.S. PATENT DOCUMENTS 237,094 A * 2/1881 Curley ..... F42B 33/04 86/38
355,362 A * 1/1887 Washburn ..... F42B 33/04 86/39
405,152 A * 6/1889 Euston ..... F42B 33/004 86/27
605,339 A * 6/1898 Place ..... F42B 33/04 86/27
755,920 A * 3/1904 Olin ..... F42B 33/002 86/18
1,340,737 A * 5/1920 Paulson ..... F41A 9/83 86/47
2,794,359 A * 6/1957 Lyman, III ..... F42B 33/04 86/36
2,953,058 A * 9/1960 Ristine, Jr. ..... F42B 33/002 198/547

(Continued)

*Primary Examiner* — Derrick R Morgan
(74) *Attorney, Agent, or Firm* — Mitchell S. W. Vap

(57) ABSTRACT

As described above, this new primer feed system is both accurate and consistent. The primer feed station begins by loading primers from the vendor packaging into the vibratory feed bowl via the primer chute. The bowl has an adjustable height polycarbonate guard that is inside the main safety polycarbonate doors and exits above the machine. The bowl then orients the primers open side up and discharges them into the primer track. Crimping can be done with 3 or 5 pins or a complete radial crimp. Previous versions of the crimp station on these crimping machines involved a pin mounted to the upper ram and a lower pin actuated by the lower ram. It was difficult to time and adjust properly for a consistent crimp. This new approach to crimping has proved much more reliable, accurate and easier to adjust. It still utilizes an upper pin mounted to the upper moving ram assembly but the lower pin is fixed.

10 Claims, 9 Drawing Sheets

(56) References Cited

U.S. PATENT DOCUMENTS 3,105,409 A * 10/1963 Schlappich, Jr. ..... F42B 33/04 86/38
3,128,668 A * 4/1964 Dicken ..... F42B 33/002 86/38
3,152,508 A * 10/1964 Fratila ..... F42B 33/04 86/38
3,153,977 A * 10/1964 Dicken ..... F42B 33/002 86/38
3,320,848 A * 5/1967 Ponsness ..... F42B 33/002 86/38
3,587,820 A * 6/1971 Lachaussee ..... B65G 29/00 198/480.1
3,714,860 A * 2/1973 Leich ..... F42B 33/04 86/20.13
3,973,465 A * 8/1976 Bachhuber ..... F42B 33/04 86/36
4,222,305 A * 9/1980 Lee ..... F42B 33/04 86/44
4,223,588 A * 9/1980 Simpson ..... F42B 33/002 86/45
4,438,867 A * 3/1984 Mayne ..... H05K 13/0447 221/274
4,522,102 A * 6/1985 Pickens ..... F42B 33/004 86/27
4,542,677 A * 9/1985 Lee ..... F42B 33/04 86/36
4,620,472 A * 11/1986 Dillon ..... F42B 33/04 86/27
4,817,491 A * 4/1989 Fenton ..... F42B 33/004 86/27
5,335,578 A * 8/1994 Lorden ..... F42B 33/002 86/28
5,341,717 A * 8/1994 Feldman ..... F42B 33/04 86/32
5,693,905 A * 12/1997 Blodgett ..... F42B 33/04 86/32
5,747,718 A * 5/1998 Bill ..... F42B 33/00 53/399
5,831,197 A * 11/1998 Bill ..... F42B 33/002 86/28
7,694,618 B1 * 4/2010 Lee ..... F42B 33/04 86/32
7,806,034 B1 * 10/2010 Lee ..... F42B 33/04 86/37
9,689,651 B1 * 6/2017 Lee ..... F42B 33/04
10,712,139 B2 * 7/2020 Heyboer ..... F42B 33/04
10,718,599 B1 * 7/2020 Kirsch ..... F42B 33/02
10,907,946 B1 * 2/2021 Lier ..... F42B 33/04
11,204,226 B1 * 12/2021 Lee ..... F42B 33/001
2014/0260925 A1 * 9/2014 Beach ..... F42B 33/002 86/28
2018/0335287 A1 * 11/2018 Tomasoni ..... F42B 33/04
2022/0276035 A1 * 9/2022 Jones ..... F42B 33/04

* cited by examiner

SMALL CALIBER CRIMPING PRIMER AND PRIMER FEED

CROSS-REFERENCE TO RELATED APPLICATIONS

This is a U.S. Nonprovisional Continuation Application, which claims priority from U.S. Non-provisional application Ser. No. 17/684,264 filed on Mar. 1, 2022, which claims priority from U.S. Provisional Application No. 63/155,121 filed Mar. 1, 2021, the disclosures of which are hereby incorporated by reference in their entirety to provide continuity of disclosure.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO SEQUENCE LISTING, A TABLE, OR A COMPUTER PROGRAM LISTING COMPACT DISC APPENDIX

Not applicable.

BACKGROUND OF THE INVENTION

Herein described is a unique crimping primer machine, wherein a new and novel way to both insert primers into cases and a safe and repeatable way to crimp the primers into position is provided.

BRIEF SUMMARY OF THE INVENTION

Inserting primers into cases safely and to the correct depth is an issue in the industry, which has not been overcome. However, the herein described machine and method provides a completely automated means to safely and precisely insert primers and crimp said primers to a case.

The original primer tracks of machines previously described in the industry consisted of a flat or nearly flat track, which required an air vibratory device to keep primers moving down the track. Also, sliding primers in a group or trying to separate them by dropping them down a tube proved to be hazardous and lead to inconsistency.

These problems were solved by tilting the primer track to a 30° angle and by lightly blowing air down the track at an angle. This method proved to be more consistent and the air has the added benefit of provided a deterrent to primers discharging up the track and into the vibratory bowl. The primer track meets up with a slot on a slide cover, which moves the primers to the primer slide. The primer slide is slotted so that the primers enter the side of the slide when fully retracted, eliminating a previous change in direction of the primers. When the slide is extended by an air cylinder the primer in the slide moves out of the way while the remaining primers stay separated in the slide cover track. As the primer in the slide moves out, it is kept in position by the slide and the slide cover along one side. When the slide is fully extended, a push rod from below lifts a spring-loaded staking pin through a staking pin holder and pushes the primer into the waiting case. The case is held down with an upper ram mounted, adjustable height case retaining pin. The case is held above the slide in a case insert. The case can move vertically only and is held in position by a spring-loaded retainer in the case insert and positioned vertically by an upper ram mounted case retaining pin.

The bottom of the case is 0.010-0.015 above the primer slide cover and primer slide. The case was loaded into the case inserts by a case feed system. The cases then pass through a flash hole laser station and into a first staking station. If there is a flash hole fault, the machine is automatically shut down. This first staking station seats the primer approximately 90% into full seating depth. The second staking pin station has a contoured end, which completes seating of the primer and is consistent due to the profile of the end of the staking pin. Once the primers are seated, the cases are rotated counterclockwise to a primer depth checking station and are checked with a laser micrometer.

After the primer depth checking station, the case then rotates to the eject/reject station. If the case with seated primer fails the primer depth check station, the case is ejected as a reject with a pneumatic cylinder. If the case passes, it enters a crimp station. Previous versions of crimp stations had two sets of opposing pins operated by an upper and lower ram. This configuration proved to be difficult to set up and led to inconsistencies over short periods of time. The present system uses upper ram mounted pins to push the primed case into a new spring loaded, table-top mounted fixture comprised of a fixed internal crimping rod. The crimping rod can be switched out with a set screw to change to different styles of crimps and for both large and small primers. The crimping rod housing, cap and spring-loaded guide are caliber specific and easily changed and reset within a very short period of time to accommodate different sizes of ammunition. After the cases are crimped, they are ejected by a mechanical arm and secondary arm to exit the machine on an eject chute.

The overall operation of the machine is comprised of an upper and lower ram connected by (4) vertical support rods. The vertical support rods are guided by bushed ball cages inside of (4) support towers. A motor drives a crankshaft with a chain, sprockets and clutch, which drives the lower ram up and down with a set of toggle arms to allow for a longer dwell time at the top and bottom of each stroke. The motor also drives the upper ram, which is comprised of special tool holders, which contain the case hold down pins. The same motor that drives the rams also turns an indexer. This 20-position indexer rotates the case insert disk in a counterclockwise direction. The indexer is chain driven and has an overload relief sensor that will stop the machine if there is too much load on the chain. The case insert disk carries the cases through each of the machine's stations in order. The case insert disk is protected by a spring and ball clutch system to avoid damage if a jam occurs.

BRIEF DESCRIPTION WITH SEVERAL VIEWS OF DRAWINGS

DETAILED DESCRIPTION OF THE INVENTION

Figure 1:
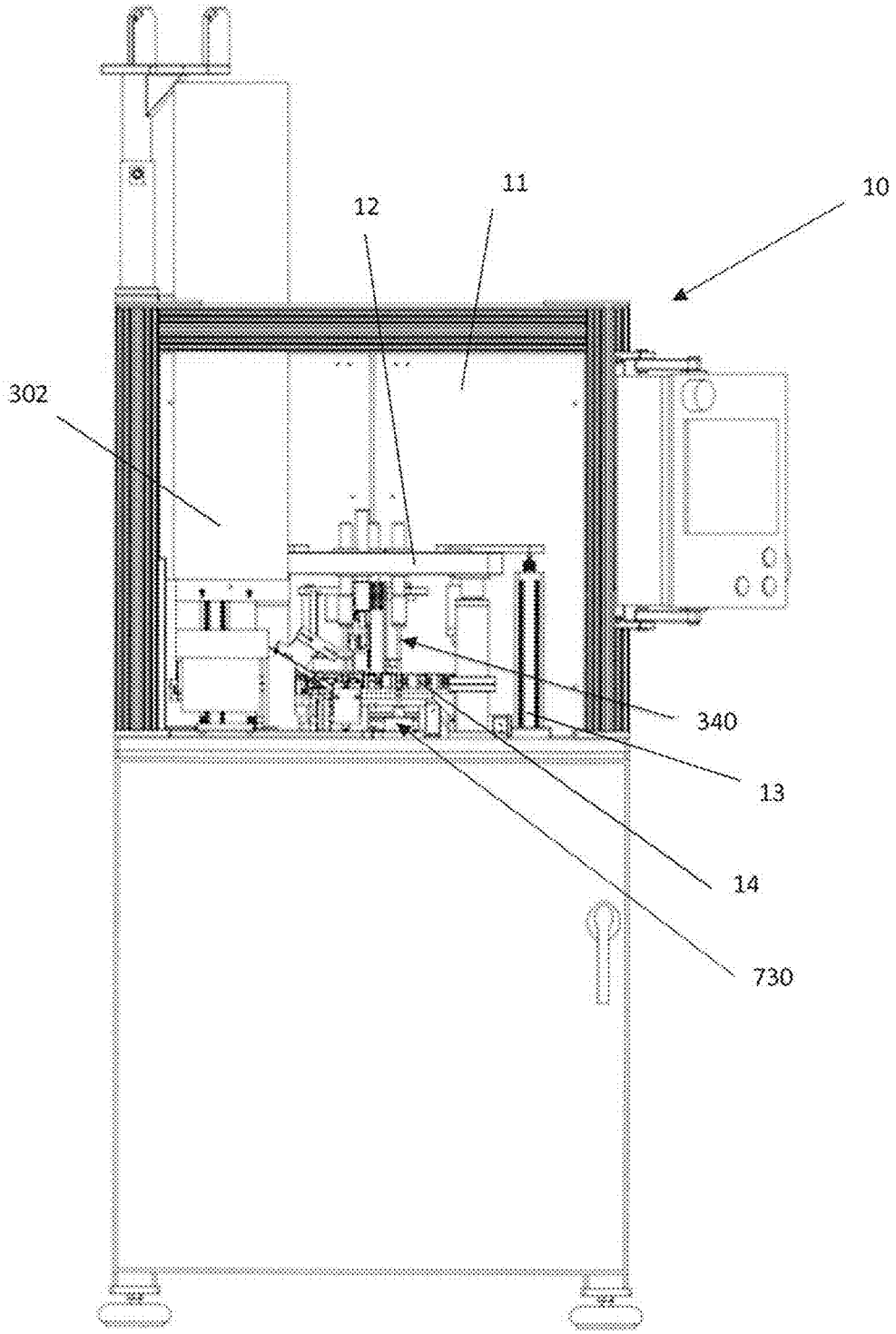
FIG. 1 is side view of the general machine assembly.
Figure 2:
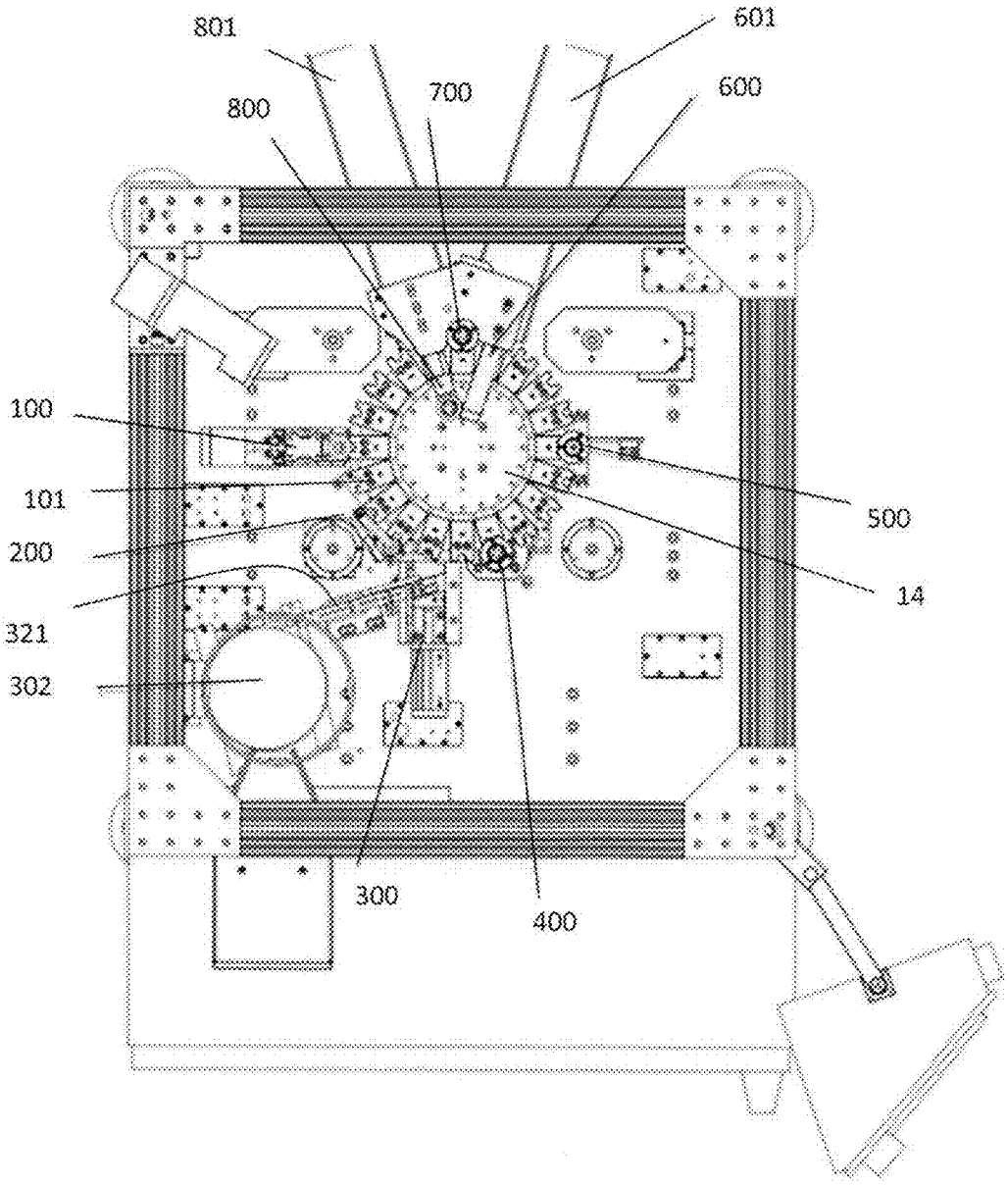
FIG. 2 is an overhead cross sectional view of the overall machine assembly showing the various stations of the machine.
Figure 3:
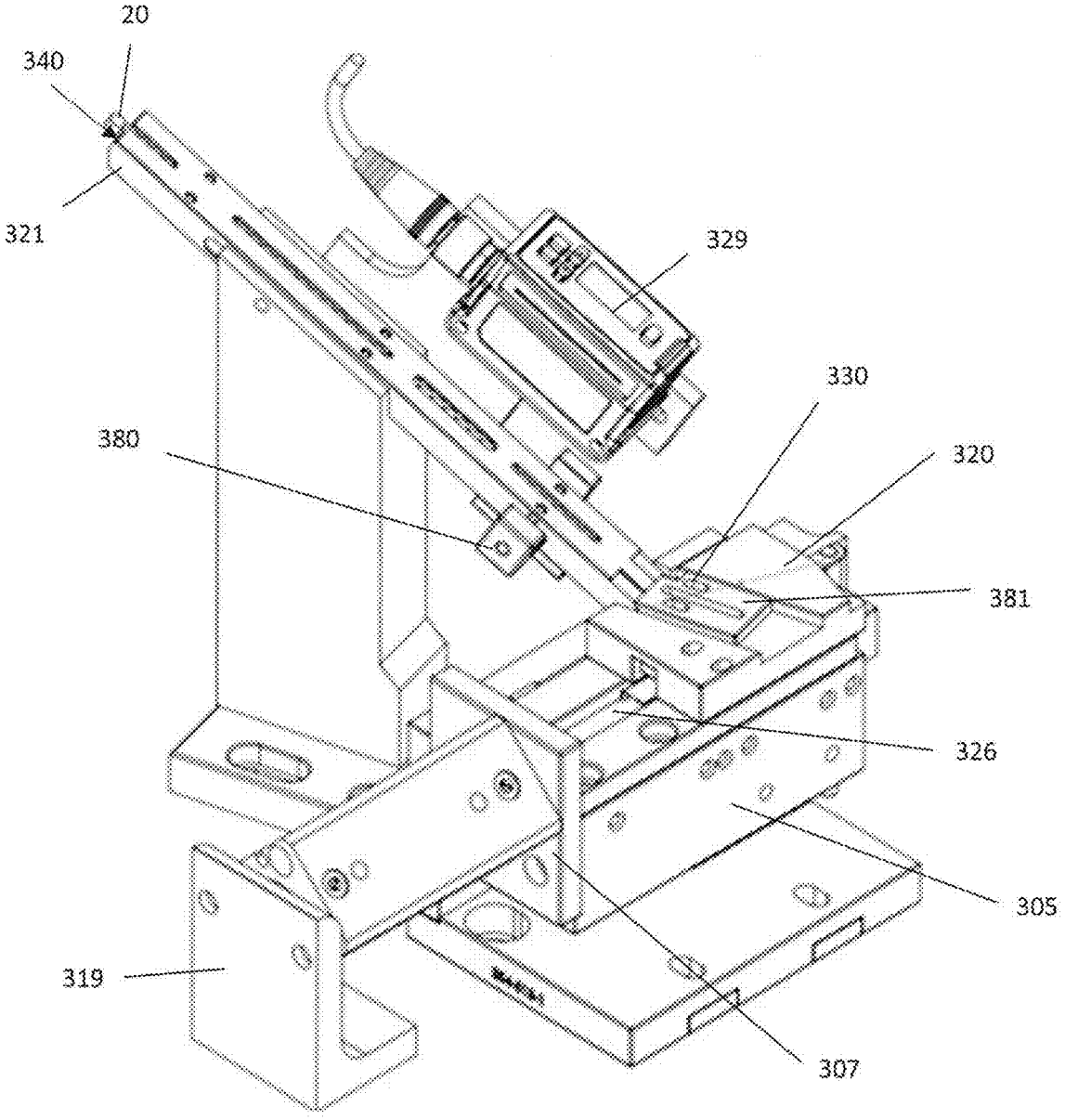
FIG. 3 is a perspective view of the primer feed assembly of the machine with covers.
Figure 4:
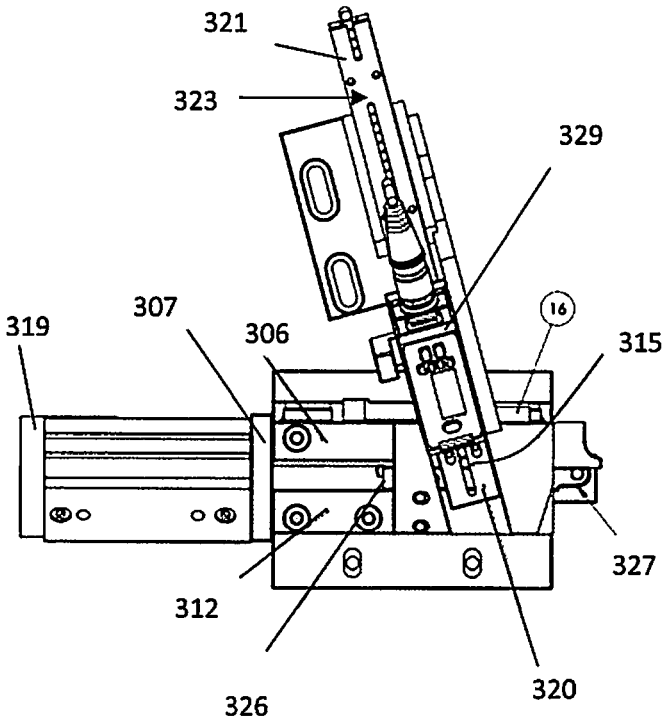
FIG. 4 is an overhead view of the primer feed assembly of the machine with covers.
Figure 5:
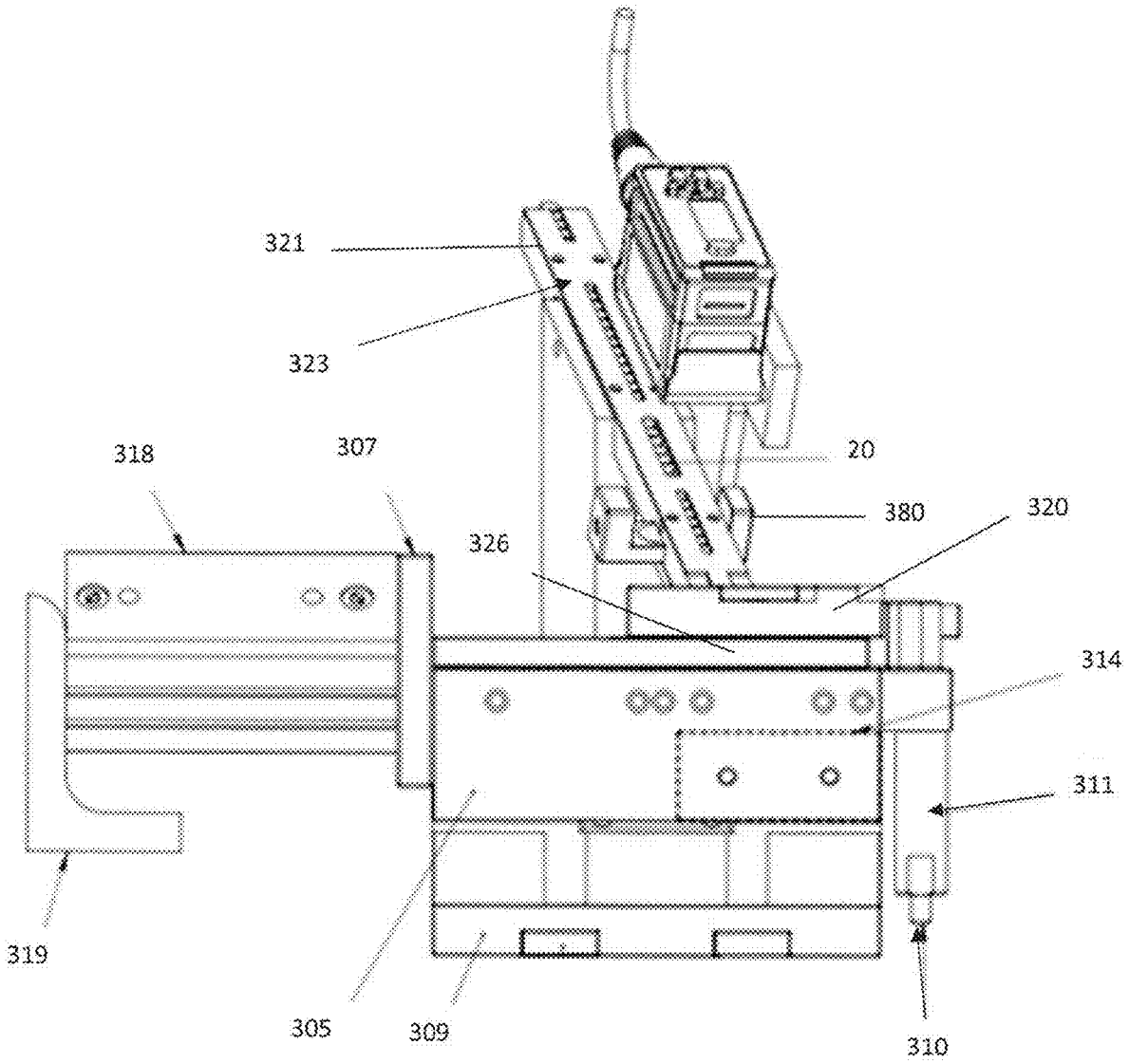
FIG. 5 is a front perspective view of the primer feed assembly of the machine with covers.
Figure 6:
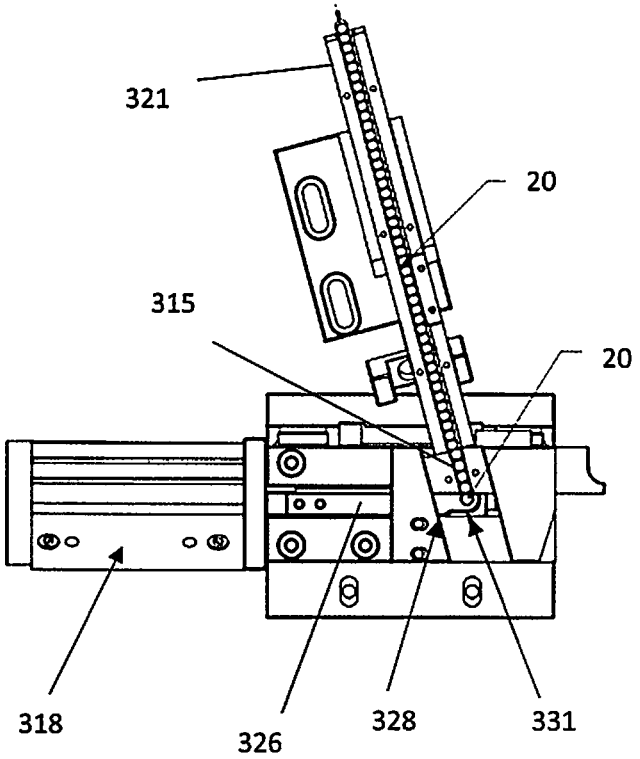
FIG. 6 is an overhead view of the primer feed assembly with covers removed and detail provided of the slide cover track with primer slide retracted.
Figure 7:
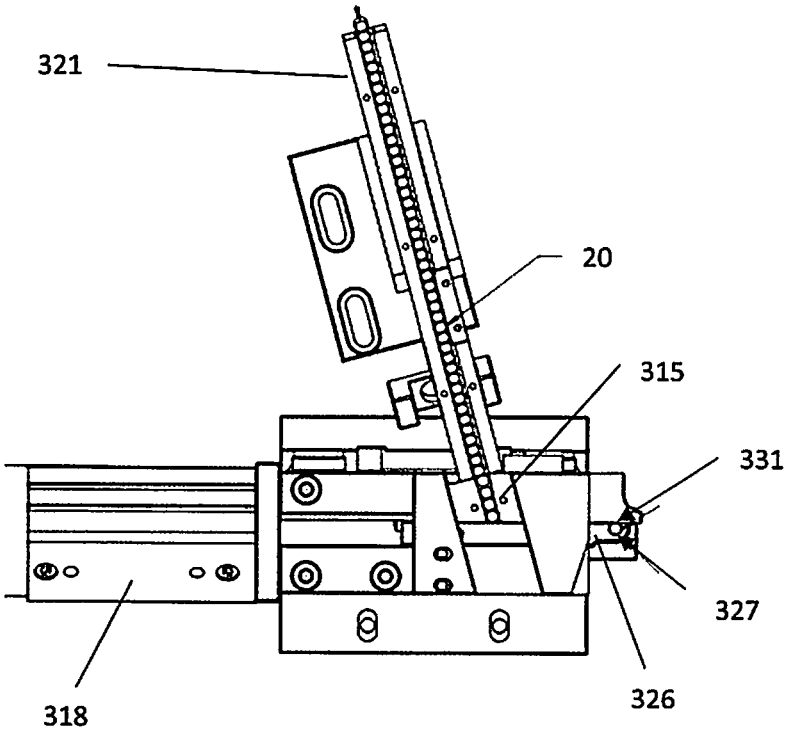
FIG. 7 is an overhead view of the primer feed assembly with covers removed and detail provided of the slide cover track with primer slide extended.
Figure 8:
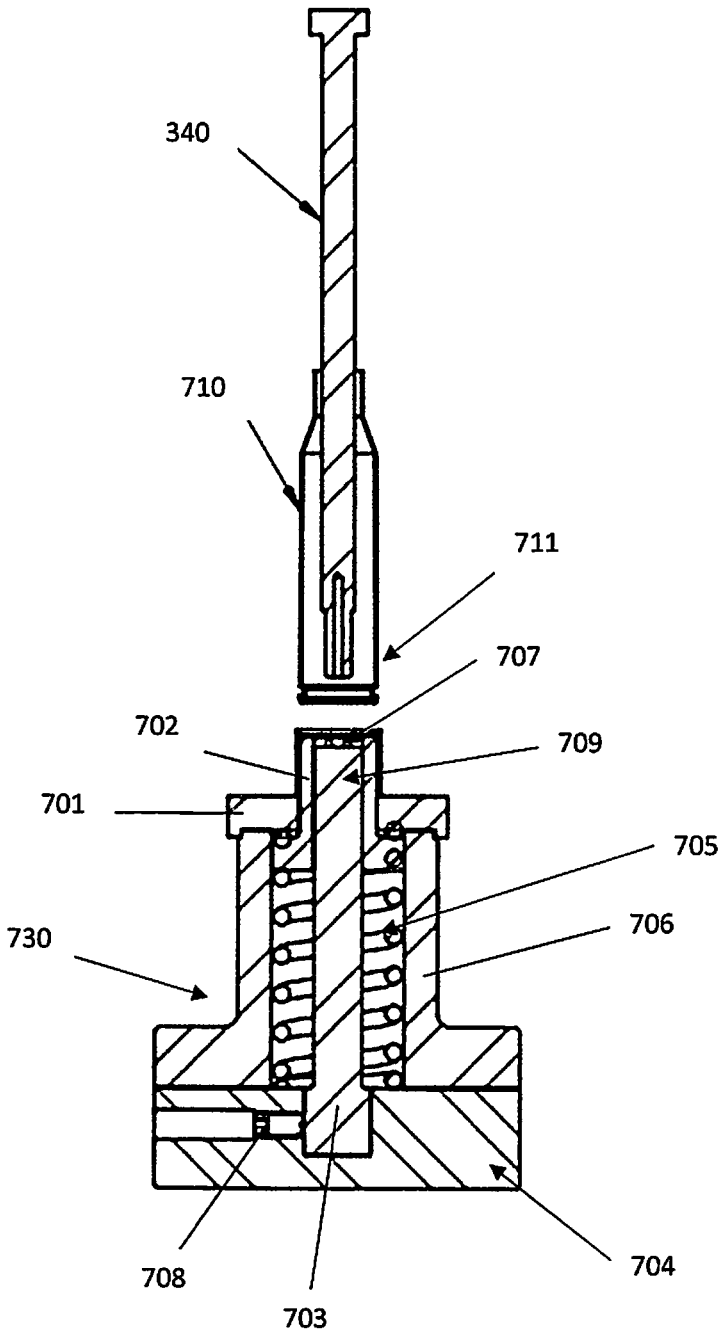
FIG. 8 is a midline sectional view of the crimp assembly of the machine.
Figure 9:
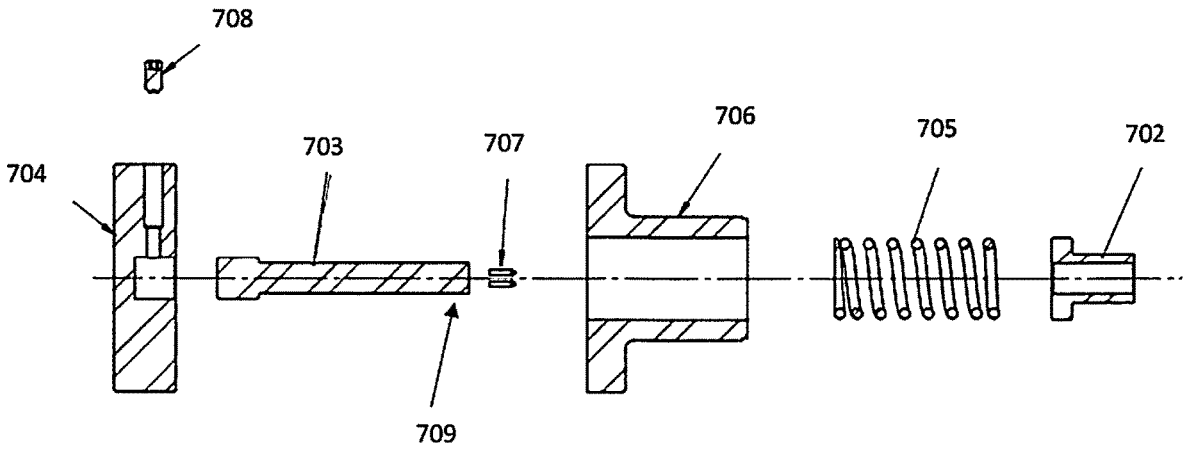
FIG. 9 is an exploded midline sectional view of the lower crimp assembly of the machine.
Figure 10:
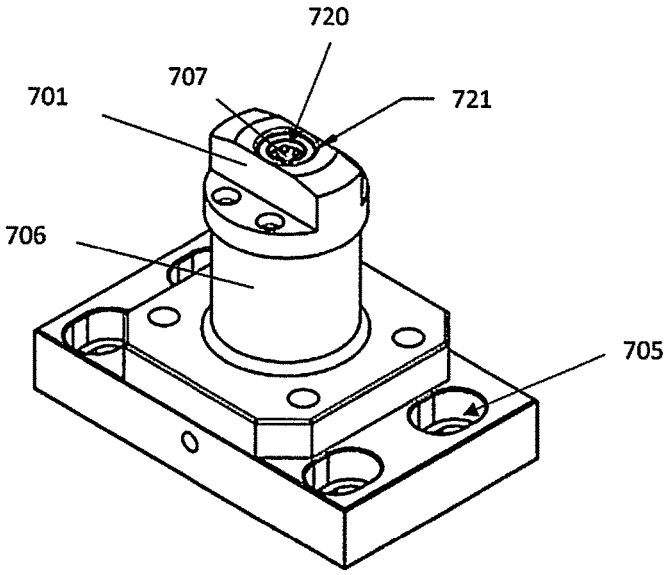
FIG. 10 is a perspective view of the crimping housing of the lower crimp assembly of the machine.
Figure 11:
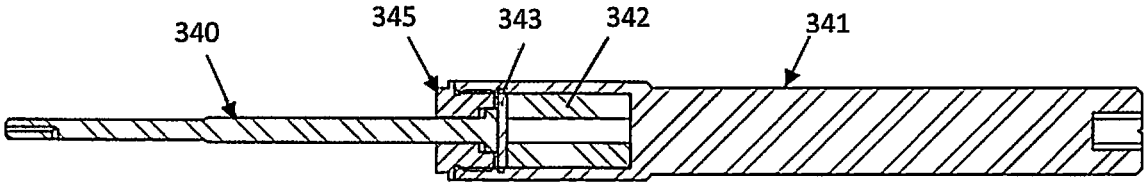
FIG. 11 is a midline sectional view of the upper case retaining pin and post assembly of the machine.

Overall machine operation: The machine 10 is contained within a clear polycarbonate housing 11 so that machine operations can be viewed, while protection is provided in the case of a primer detonation. The machine 10 is comprised of eight (8) separate stations where machine 10 operations are performed. The overall operation of the machine is comprised of an upper ram 12 and lower ram connected by (4) vertical support rods 13. The vertical support rods 13 are guided by bushed ball cages inside of (4) support towers. A motor drives a crankshaft with a chain, sprockets and clutch, which drives the lower ram up and down with a set of toggle arms to allow for a longer dwell time at the top and bottom of each stroke. The motor also drives the upper ram 12, which is comprised of special tool holders, further comprised of case retaining pins 340 which secure cases during operation of the machine. The same motor that drives the rams also turns an indexer. This 20-position indexer rotates a case insert disk 14 in a counterclockwise direction. The indexer is chain driven and has an overload relief sensor that will stop the machine if there is too much load on the chain. The case insert disk 14 carries cases through each of the machine's stations in order. The case insert disk 14 is protected by a spring and ball clutch system to avoid damage if a jam occurs.

The stations of the machine are comprised of the following in order of operation. (1) A case feed station 100 where empty cases are fed to and inserted into case inserts 101 of said case insert disk 14. (2) A flash hole check station 200, comprising a laser check station, wherein if there is a flash hole fault, the machine 10 will be automatically shut down. (3) A primer feed and initial staking station 300 where primers 20 are fed and positioned for staking. The initial staking station seats the primer 20 approximately 90% into full seating depth. (4) A final depth staking station 400, comprising a second staking pin station with a contoured end, which completes seating of the primer 20 and maintains consistency due to the contoured profile of the end of the second staking pin. (5) A primer depth checking station 500, comprising a laser micrometer where primer depth is measured. (6) A reject station 600, where if a case with seated primer 20 fails the primer depth check station 500, the case is ejected from final production as a reject by a pneumatic cylinder means onto a reject chute 601. (7) A crimping station 700 wherein cases are crimped to said primers 20. (8) An eject station 800, wherein primed cases 710 ejected by a mechanical arm and secondary arm to exit the machine 10 on to an eject chute 801.

Primer feed and initial staking station detail: As described above, this new primer feed system is both accurate and consistent. The primer feed station 300 begins by loading primers 20 from vendor packaging into a vibratory feed bowl 302 via a primer chute. The vibratory feed bowl has an adjustable height polycarbonate guard that is inside the main safety polycarbonate housing 11 and exits above the machine 10. The vibratory feed bowl orients the primers 20 open side up and discharges them into a primer track 321.

The primer track 321 is covered with a replaceable cover 323 that is slotted to allow any primer detonation to be contained but not confined. The primer track 321 is slanted at a 30 degree angle to allow the primers to slide down by gravity with air assist. The air is fed in from the top of the primer track 321 by an angle hole 340 pointing down the primer track 321. The primers 20 are checked for orientation by a camera 329 mounted above the primer track 321. If an upside-down primer is detected, the machine 10 is shut off to clear the primer.

The primer track 321 is further comprised of a spring-loaded push opening 380 mounted below the primer track 321 to allow individual primer removal. As the primers exit the end of the primer track 321, they enter a slide cover track 315. The slide cover track 315 is horizontal and is machined into the slide cover 320. The slide cover 320 is further comprised of a slotted removable cover 381 to keep the primers 20 contained. The slide cover track 315 and slide cover 320 are both at a 15 degree angle to a primer slide 326. This angle keeps the primers flowing into the primer slide 326 and prevents pinching when the primer slide 326 is extended 327. The primer slide 326 is supported inferiorly by a slide support 314. The slide cover track 315 mounting holes 330 are slotted to allow forward and back movement of the cover. This movement allows the slide cover track 315 to locate within the recess 331 at the distal end of the primer slide 326. The primer slide 326 is a key feature of the primer feed and is recessed 331 on the left side to allow the primers 20 to enter from the slide cover track 315.

The recess 331 where the primers sit in the primer slide 326 is also 0.003-0.005 lower than the slide cover track 315 to create a space between the top of said recess 331 and the bottom of said slide cover track 315, which allows further separation between the primers 20. The primer slide 326 is actuated by a pneumatic cylinder 318 supported by a stabilizer 319 at a first end and connected to a slide track housing 305 at the cylinder's 318 second end by an end plate 307. Said slide track housing 305 is further comprised of a left cap 306 and right cap 312, which house and locate said primer slide 326. Said slide track housing 305 is mounted to a bottom base plate 309.

Air to the cylinder 318 can be turned off in the event of a "no case fault" at the case feed station 100 or to keep from feeding primers in pre-primed brass. After the indexer has moved a case into position, the cylinder 318 is actuated to extend 327 the primer slide 326. When the primer slide 326 is extended 327, a push rod from below lifts the spring-loaded staking pin 310 through the staking pin holder 311 and pushes the primer into the waiting case. The case is held down with an upper ram 12 mounted, adjustable height case retaining pin 340. After the primer has been inserted, the primer slide 326 is retracted 328 and another primer moves into the recess 331 of the primer slide 326.

Crimping station detail: Crimping a primed case requires precise disruption of the case material at the primer location to pinch in the primer hole slightly to prevent the primer from coming loose when fired, which can lead to a gun jam. Crimping can be done with 3 or 5 pins or a complete radial crimp. Previous versions of crimp stations on utilized a pin mounted to an upper ram and a lower pin actuated by a lower ram. However, this configuration and method was difficult to time and adjust properly for a consistent crimp.

The present approach to crimping has proved to be much more reliable, accurate and easier to adjust. The present method still utilizes an upper-case retaining pin 340 mounted to the upper ram 12 assembly; however, the lower crimping pin is fixed.

The crimping station 700 is comprised of said upper-case retaining pin 340 mounted to the upper ram 12 assembly by a retaining pin post 341. Said case retaining pin 340 is connected to a lower end of a retaining pin post 341 by a pin retainer 345. An upper end of said case retaining pin 340 abuts a pin spacer 343 within a recess 350 of the lower end of said retaining pin post 341. Said pin spacer 343 abuts a compression spring 342 within the recess 350 of the lower end of said retaining pin post 341, which provides a longitudinal downward force upon said case retaining pin 340 which presses the case into the lower crimp assembly 730 described below.

The crimping station 700 is further comprised of a lower crimp assembly 730 comprised of a base 704, with a plurality of slotted holes 705 to allow for adjustment in relation to the case insert disk 14. The base 704 is comprised of a hole on its top surface which accepts a corresponding bottom end of a crimping pin 703 which is held in place with a set screw 708. The top end 709 of the crimping pin 703 is comprised of either a 3 or 5 pin set 707 of crimping tools inserted in the top end 709 of the crimping pin 703 or a continuous machined feature of the top end 709 of the crimping pin 703 to accomplish radial crimping. A crimp housing 706 is bolted to the base 704 which houses and locates said crimping pin 703 and a spring-loaded 705 guide 702. The spring-loaded 705 guide 702 slides up and down on the crimping pin 703 within the crimp housing 706. The spring-loaded 705 guide 702 pushes against the base 711 of the primed case 710 and returns to an upper position when crimping is completed. A cap 701 retains the guide 702 and centers the case over the crimping pin 703. The cap 701 is comprised of a chamfered 721 case hole 720, which centers the case over the crimping pin 703 and pin set 707. Different calibers and primer sizes can be accommodated by interchanging the crimp housing 706, guide 702, crimping pin 703, pin set 707 and cap 701.

After the cases are crimped, typically the cases are sealed and loaded on a separate piece of equipment for safety and cleanliness concerns.

It is understood that the foregoing examples are merely illustrative of the present invention. Certain modifications of the articles and/or methods may be made and still achieve the objectives of the invention. Such modifications are contemplated as within the scope of the claimed invention.

What is claimed is:

1. An ammunition primer feed and staking station comprising:

a primer track comprised of a first top end, which receives primers;

a second bottom end wherein said primers exit said primer track, wherein said primer track is slanted to allow gravity to assist said primers movement from said first end to said second end;

wherein said primers exit said second bottom end of said primer track and enter a slide cover track; and wherein a horizontal primer slide comprises a recess to allow said primers to enter from said slide cover track.

2. The ammunition primer feed and staking station of claim 1, wherein said primer track is slanted at an approximate 30-degree angle.

3. The ammunition primer feed and staking station of claim 1, wherein said primer track is further comprised of an angle hole of said first top end of said primer track, wherein said angle hole directs air from said first top end to said second bottom end of said primer track to assist with said primers' movement from said first end to said second end.

4. The ammunition primer feed and staking station of claim 1, wherein said primer track is further comprised of a camera mounted above said primer track.

5. The ammunition primer feed and staking station of claim 1, wherein said primer track is further comprised of a spring-loaded push opening mounted below said primer track to allow individual primer removal.

6. The ammunition primer feed and staking station of claim 1, wherein said slide cover track is at an approximate 15-degree angle to said horizontal primer slide.

7. The ammunition primer feed and staking station of claim 6, wherein said slide cover track is further comprised of a plurality of slotted mounting holes, which allow movement of a slide cover.

8. The ammunition primer feed and staking station of claim 1, wherein said recess is lower than said slide cover track.

9. The ammunition primer feed and staking station of claim 7, wherein said primer slide is actuated by a pneumatic cylinder to extend said primer slide.

10. The ammunition primer feed and staking station of claim 9, wherein said primer feed and initial staking station is further comprised of a push rod, which lifts a staking pin to push said primer into a case while said primer slide is extended.

* * * * *